US012263920B2

(12) United States Patent
Thomson et al.

(10) Patent No.: US 12,263,920 B2
(45) Date of Patent: Apr. 1, 2025

(54) RETROFITTING A BUOY TO PROVIDE DYNAMIC CONTROL OF A FREEBOARD OF THE BUOY

(71) Applicant: The United States of America, as represented by the Secretary of the Navy, San Diego, CA (US)

(72) Inventors: Bret R. Thomson, San Diego, CA (US); Jason S. Bench, El Cajon, CA (US); Kevin A. Merhoff, San Diego, CA (US); Brandon J. Wiedemeier, San Diego, CA (US); Nathan Todd Miller, San Diego, CA (US); Minh Vuong, San Diego, CA (US); Bryan B. Bui-Tuong, San Diego, CA (US)

(73) Assignee: United States of America, as represented by the Secretary of the Navy, Washington, DC (US)

( * ) Notice: Subject to any disclaimer, the term of this patent is extended or adjusted under 35 U.S.C. 154(b) by 428 days.

(21) Appl. No.: 17/835,782

(22) Filed: Jun. 8, 2022

(65) Prior Publication Data

US 2023/0399079 A1 Dec. 14, 2023

(51) Int. Cl.
*B63B 22/20* (2006.01)

(52) U.S. Cl.
CPC ..... *B63B 22/20* (2013.01); *B63B 2207/02* (2013.01)

(58) Field of Classification Search
CPC ..... B63B 22/00; B63B 22/18; B63B 22/20; B63B 22/22; B63B 2207/00; B63B 2207/02; B63B 2207/04
USPC ..... 441/1, 21, 28, 29, 30
See application file for complete search history.

(56) References Cited

U.S. PATENT DOCUMENTS

| | | | | |
|---|---|---|---|---|
| 7,699,677 | B2 * | 4/2010 | Yoshida | B63C 11/00 441/29 |
| 8,875,645 | B1 * | 11/2014 | Webb | G01C 13/00 441/32 |
| 9,272,756 | B1 | 3/2016 | Thomson | |
| 10,569,839 | B1 | 2/2020 | Thomson | |

* cited by examiner

*Primary Examiner* — Daniel V Venne
(74) *Attorney, Agent, or Firm* — Naval Information Warfare Center, Pacific; Kyle Eppele; Andrew J. Cameron

(57) ABSTRACT

A retrofit kit retrofits a buoy to provide dynamic control of a freeboard of the retrofitted buoy. The retrofit kit includes buoyancy chambers, an air reservoir, and a valve arrangement. A method for retrofitting a buoy retrofits a buoy to provide dynamic control of a freeboard of the retrofitted buoy. The buoyancy chambers surrounding a vertical axis of the buoy with a center of mass of the buoy disposed on the vertical axis below the buoyancy chambers. The buoyancy chambers provide a variable buoyancy ranging from a minimum buoyancy to a maximum buoyancy. The air reservoir inflates of the buoyancy chambers. The valve arrangement dynamically sets the freeboard of the buoy upon inflation and deflation of the buoyancy chambers for varying the variable buoyancy between the minimum buoyancy and the maximum buoyancy.

10 Claims, 4 Drawing Sheets

RETROFITTING A BUOY TO PROVIDE DYNAMIC CONTROL OF A FREEBOARD OF THE BUOY

FEDERALLY-SPONSORED RESEARCH AND DEVELOPMENT

The United States Government has ownership rights in this invention. Licensing and technical inquiries may be directed to the Office of Research and Technical Applications, Naval Information Warfare Center Pacific, Code 72120, San Diego, CA, 92152; voice (619) 553-5118; ssc_pac_t2@navy.mil. Reference Navy Case Number 112199.

BACKGROUND OF THE INVENTION

Generally, buoys spend their entire system life on the surface, but this puts them in danger of damage from high surf, storms, sabotage, detection, or theft. There therefore exists a need for a buoy to withstand these perils.

SUMMARY

A retrofit kit retrofits a buoy to provide dynamic control of a freeboard of the retrofitted buoy. The retrofit kit includes buoyancy chambers, an air reservoir, and a valve arrangement. A method for retrofitting a buoy retrofits a buoy to provide dynamic control of a freeboard of the retrofitted buoy. The buoyancy chambers surrounding a vertical axis of the buoy with a center of mass of the buoy disposed on the vertical axis below the buoyancy chambers. The buoyancy chambers provide a variable buoyancy ranging from a minimum buoyancy to a maximum buoyancy. The air reservoir inflates of the buoyancy chambers. The valve arrangement dynamically sets the freeboard of the buoy upon inflation and deflation of the buoyancy chambers for varying the variable buoyancy between the minimum buoyancy and the maximum buoyancy.

BRIEF DESCRIPTION OF THE DRAWINGS

Throughout the several views, like elements are referenced using like references. The elements in the figures are not drawn to scale and some dimensions are exaggerated for clarity.

DETAILED DESCRIPTION OF EMBODIMENTS

The disclosed methods and systems below may be described generally, as well as in terms of specific examples and/or specific embodiments. For instances where references are made to detailed examples and/or embodiments, it should be appreciated that any of the underlying principles described are not to be limited to a single embodiment, but may be expanded for use with any of the other methods and systems described herein as will be understood by one of ordinary skill in the art unless otherwise stated specifically.

The inventors have discovered that a buoy or other unmanned maritime vehicle can avoid perils on the surface by automatically descending to a certain depth, and this is achieved with the disclosed dynamic control of the freeboard of the buoy at low cost using commercial off the shelf (COTS) components.

Figure 1:
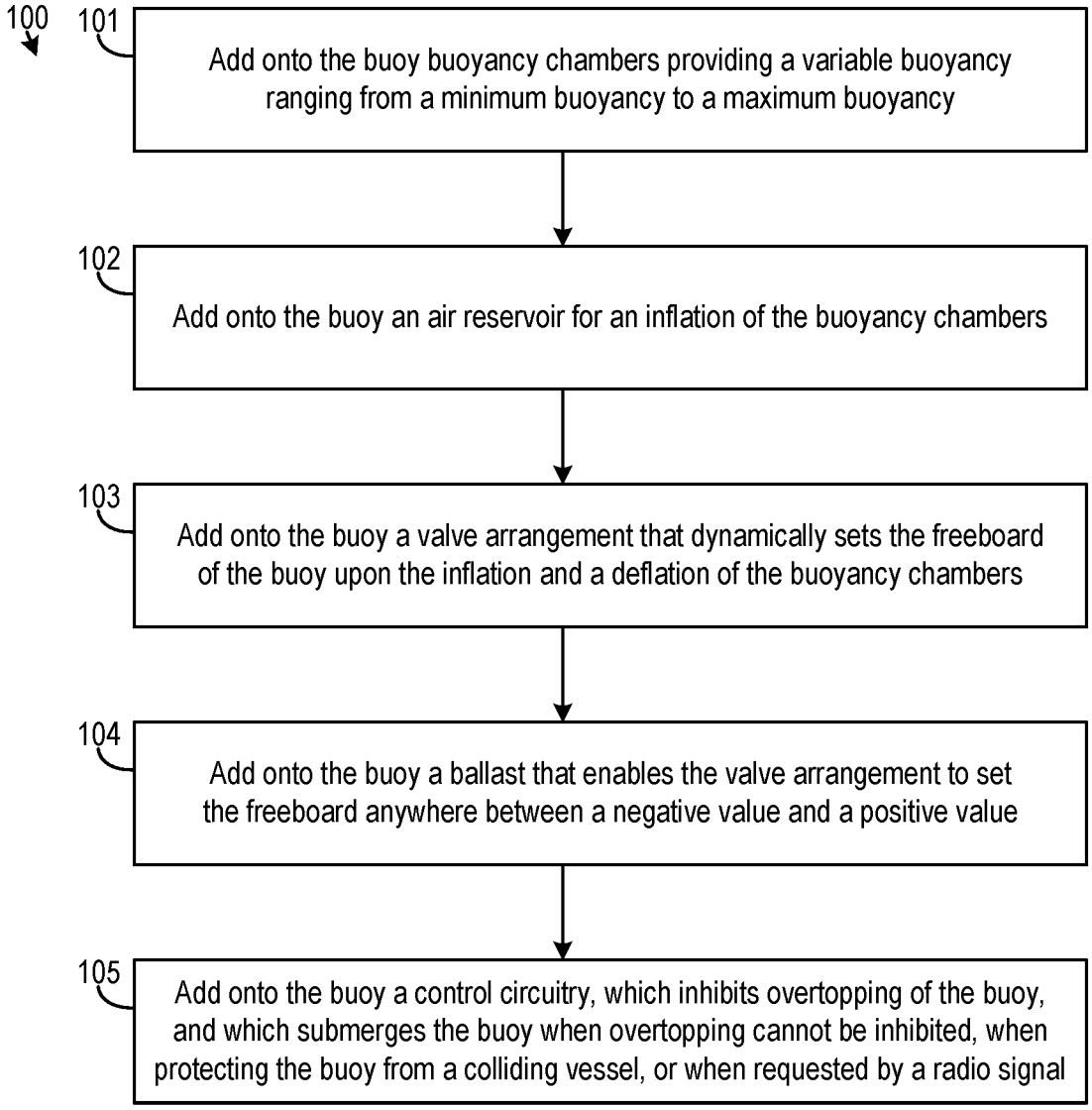
FIG. 1 is a flow diagram of a process for retrofitting a buoy to provide dynamic control of a freeboard in accordance with an embodiment of the invention.

FIG. 1 is a flow diagram of a process 100 for retrofitting a buoy to provide dynamic control of a freeboard in accordance with an embodiment of the invention. Typically, the buoy has a fixed positive freeboard before retrofitting, but after retrofitting the buoy provides dynamic control of the freeboard, including setting the freeboard to a negative value for completely submerging the buoy.

At step 101, buoyancy chambers are added onto the buoy. The buoyancy chambers surround a vertical axis of the buoy, with a center of mass of the buoy disposed on the vertical axis below the buoyancy chambers. The buoyancy chambers provide a variable buoyancy ranging from a minimum buoyancy to a maximum buoyancy.

At step 102, an air reservoir for an inflation of the buoyancy chambers is added onto the buoy.

At step 103, a valve arrangement is added onto the buoy. The valve arrangement dynamically sets the freeboard of the buoy upon the inflation and a deflation of the buoyancy chambers, and this varies the variable buoyancy between the minimum buoyancy and the maximum buoyancy.

At step 104, a ballast is added onto the buoy. The ballast is disposed along the vertical axis below the buoyancy chambers. The buoy has the freeboard with an initial positive value before the retrofitting with the buoyancy chambers, the air reservoir, the valve arrangement, and the ballast, but, after the retrofitting, the valve arrangement sets the freeboard anywhere between a negative value, which is achieved when the buoyancy chambers provide the minimum buoyancy, and another positive value, which is achieved when the buoyancy chambers provide the maximum buoyancy.

The valve arrangement dynamically sets the freeboard of the buoy anywhere between the negative value and the positive value. The valve arrangement sets the freeboard to the positive value upon the inflation of the buoyancy chambers with the air from the air reservoir to provide the maximum buoyancy; the valve arrangement sets the freeboard to the negative value upon the deflation of the buoyancy chambers to provide the minimum buoyancy.

The negative value of the freeboard provides complete submersion of the buoy after retrofitting for a buoy designed before retrofitting to never submerge because the buoy has the freeboard with the initial positive value before retrofitting.

At step 105, a control circuitry is added onto the buoy. In response to a measure of a turbulence of a body of water surrounding the buoy, the control circuitry dynamically directs the valve arrangement to set the freeboard to a positive value just sufficient to inhibit overtopping of the buoy by the turbulence of the body of water.

In response to the measure of the turbulence indicating the turbulence is so high that overtopping of the buoy by the turbulence of the body of water cannot be inhibited even upon setting the freeboard to the positive value when the buoyancy chambers provide the maximum buoyancy, the control circuitry directs the valve arrangement to set the freeboard to the negative value for completely submerging the buoy within the body of water and for protecting the buoy from the turbulence of the body of water.

In response to a detected approach of a vessel on a collision course with the buoy, the control circuitry directs the valve arrangement to set the freeboard to the negative value for completely submerging the buoy and for protecting the buoy from the vessel. For example, a sensor detects the presence of radio signals at a power level that indicates the vessel is nearby, and then the buoy submerges to protect and conceal the buoy.

In response to a received radio signal with a remote control message requesting a temporary submergence of the buoy, the control circuitry temporarily directs the valve arrangement to set the freeboard to the negative value for completely submerging and concealing the buoy.

Figure 2A:
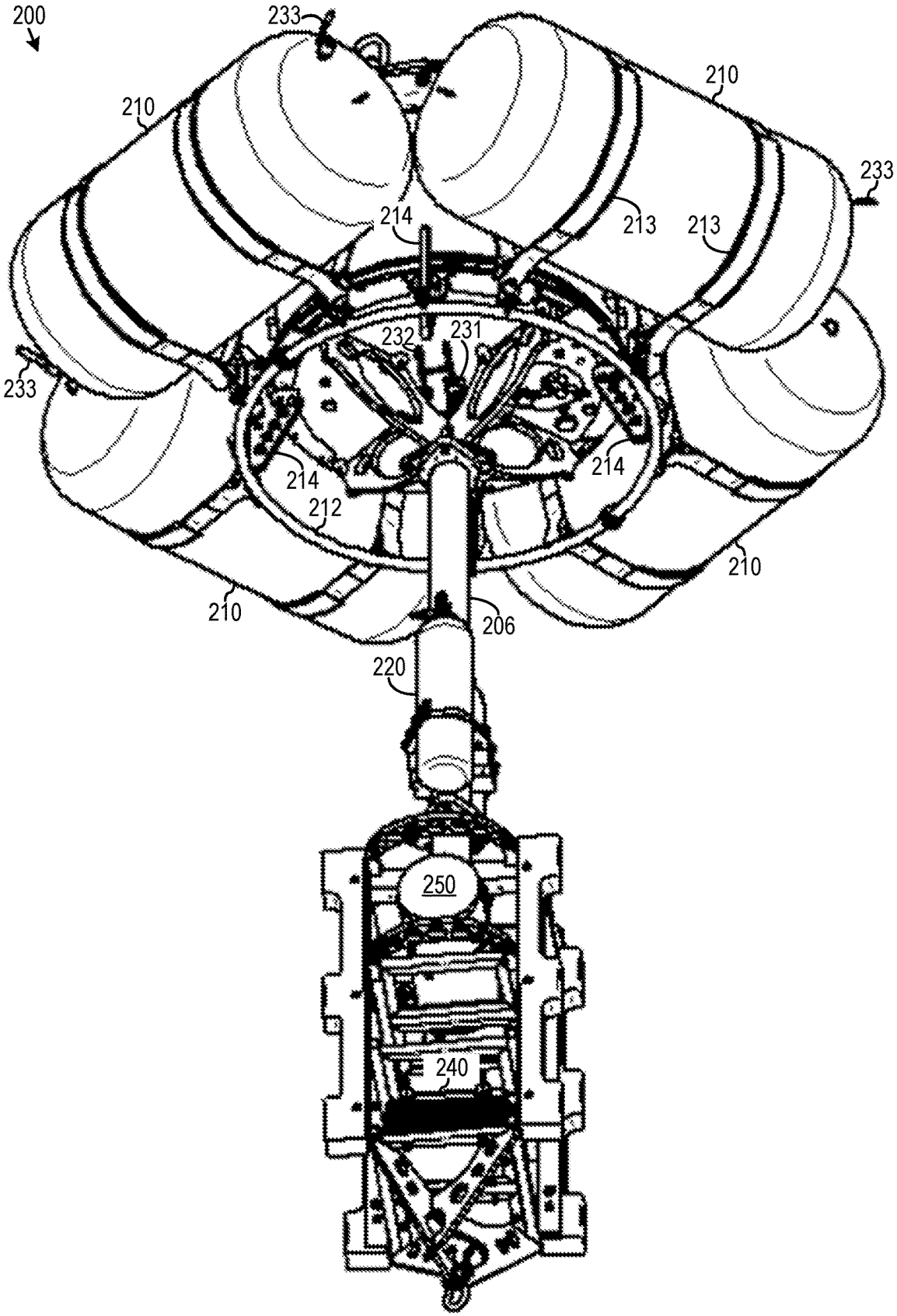
FIG. 2A a perspective view of a buoy after retrofitting the buoy to provide dynamic control of a freeboard of the buoy in accordance with an embodiment of the invention.
Figure 2B:
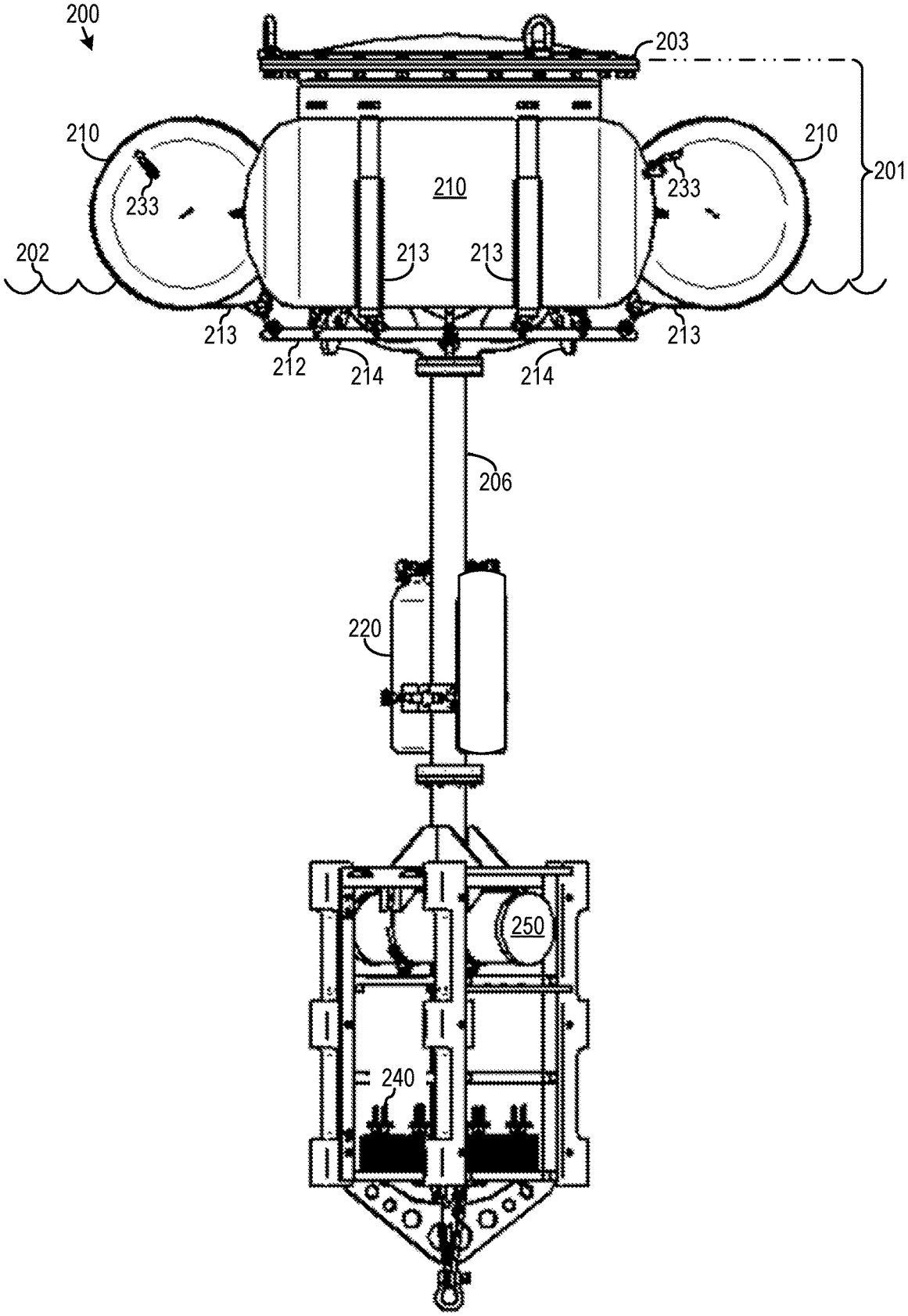
FIG. 2B is a side view of the buoy of FIG. 2A.

FIG. 2A and FIG. 2B are respectively a perspective view and a side view of a buoy 200 after retrofitting the buoy 200 to provide dynamic control of a freeboard 201 of the buoy 200 in accordance with an embodiment of the invention.

The buoy includes buoyancy chambers 210 surrounding a vertical axis of the buoy 200 with a center of mass of the buoy 200 disposed on the vertical axis below the buoyancy chambers 210. The buoyancy chambers 210 provide a variable buoyancy ranging from a minimum buoyancy to a maximum buoyancy. The buoy includes an air reservoir 220 for an inflation of the buoyancy chambers 210.

In one embodiment, the buoyancy chambers 210 are lift bags and the air reservoir 220 is one or more self-contained underwater breathing apparatus (SCUBA) tanks. Each SCUBA tank has a pressure regulator, and because the SCUBA tanks are typically disposed under the body of water 202, the pressure regulators regulate a slight positive pressure for inflating the buoyancy chambers 210, and the magnitude of this slight positive pressure is determined by a depth of the SCUBA tanks under the buoyancy chambers 210. In another embodiment, the buoyancy chambers 210 are rigid shells providing variable buoyancy from moving a virtually incompressible fluid between an internal chamber and unpressurized storage, which is either an internal flooded holding area or an external unpressurized storage. Pressurized air from air reservoir 220 pushes this incompressible fluid out of the internal chamber, or a motor drives a piston or a pump to move this incompressible fluid out of the internal chamber to the unpressurized storage.

The buoy 200 includes a valve arrangement for dynamically setting the freeboard 201 of the buoy upon the inflation and a deflation of the buoyancy chambers for varying the variable buoyancy between the minimum buoyancy and the maximum buoyancy. In one embodiment, the valve arrangement includes an inflation valve 231, a release valve 232, and over-pressure valves 233. The inflation valve 231 controls passage of air from the air reservoir 220 to the buoyancy chambers 210 for increasing the variable buoyancy. The release valve 232 releases gas from the buoyancy chambers 210 through a vent to a surrounding atmosphere for lowering the variable buoyancy. In another embodiment, a compressor deflates the buoyancy chambers 210 back into the air reservoir 220 via the release valve 232. For self-preservation of the buoyancy chambers 210, the over-pressure valves 233 prevent damage to the buoyancy chambers 210 by releasing excess air from the buoyancy chambers 210. Typically, the inflation valve 231 and a release valve 232 are electrically actuated by control circuitry and power cells within pressure vessel 250. Alternatively, the control circuitry and power cells are positioned inside the hollow mast 206 or elsewhere within the buoy 200.

A ballast 240 is disposed along the vertical axis below the buoyancy chambers 210. The buoy 200 has the freeboard 201 with an initial positive value before the retrofitting with the buoyancy chambers 210, the air reservoir 220, the valve arrangement including valves 231 through 233, and the ballast 240, but, after the retrofitting, the valve arrangement sets the freeboard 201 anywhere between a negative value, which is achieved when the buoyancy chambers 210 provide the minimum buoyancy, and another positive value, which is achieved when the buoyancy chambers 210 provide the maximum buoyancy. Typically, the ballast 240 is configured during the retrofitting to set the freeboard 201 at the negative value when the buoyancy chambers 210 provide the minimum buoyancy, but the ballast 240 remains nominally unchanged after the retrofitting while the valve arrangement sets the freeboard 201 of the buoy 200 anywhere between the negative and positive values. It will be appreciated that marine growth and corrosion slowly change the ballast 240.

When the buoy 200 is configured as a wave-following buoy, the ballast 240 is selected so that the body of water 202 normally rests toward the bottom of the buoyancy chambers 210 as shown in FIG. 2B. When the buoy 200 is instead configured as a spar buoy, the ballast 240 is selected so that the body of water 202 normally rests toward the top of the buoyancy chambers 210. However, the buoyancy chambers 210 often provide enough dynamic range to dynamically switch between a wave-following buoy and a spar buoy when the ballast 240 is selected so that the body of water 202 normally rests at the middle of the buoyancy chambers 210. The buoy 200 is either free floating or moored by a line between the buoy 200 and an anchor (not shown).

In one embodiment, the retrofitted buoy 200 includes a ring strut 212 encircling the vertical axis for mounting the buoyancy chambers 210 to the buoy 200. Straps 213 mount the buoyancy chambers 210 to the ring strut 212, and adjustable brackets 214 mount the ring strut 212 to the retrofitted buoy 200. The adjustable brackets 214 vary a height of the ring strut 212 relative to an upper deck platform 203 of the buoy 200. Thus, the adjustable brackets 214 determine a maximum positive value for the freeboard 201 when the buoyancy chambers 210 provide the maximum buoyancy.

Figure 3:
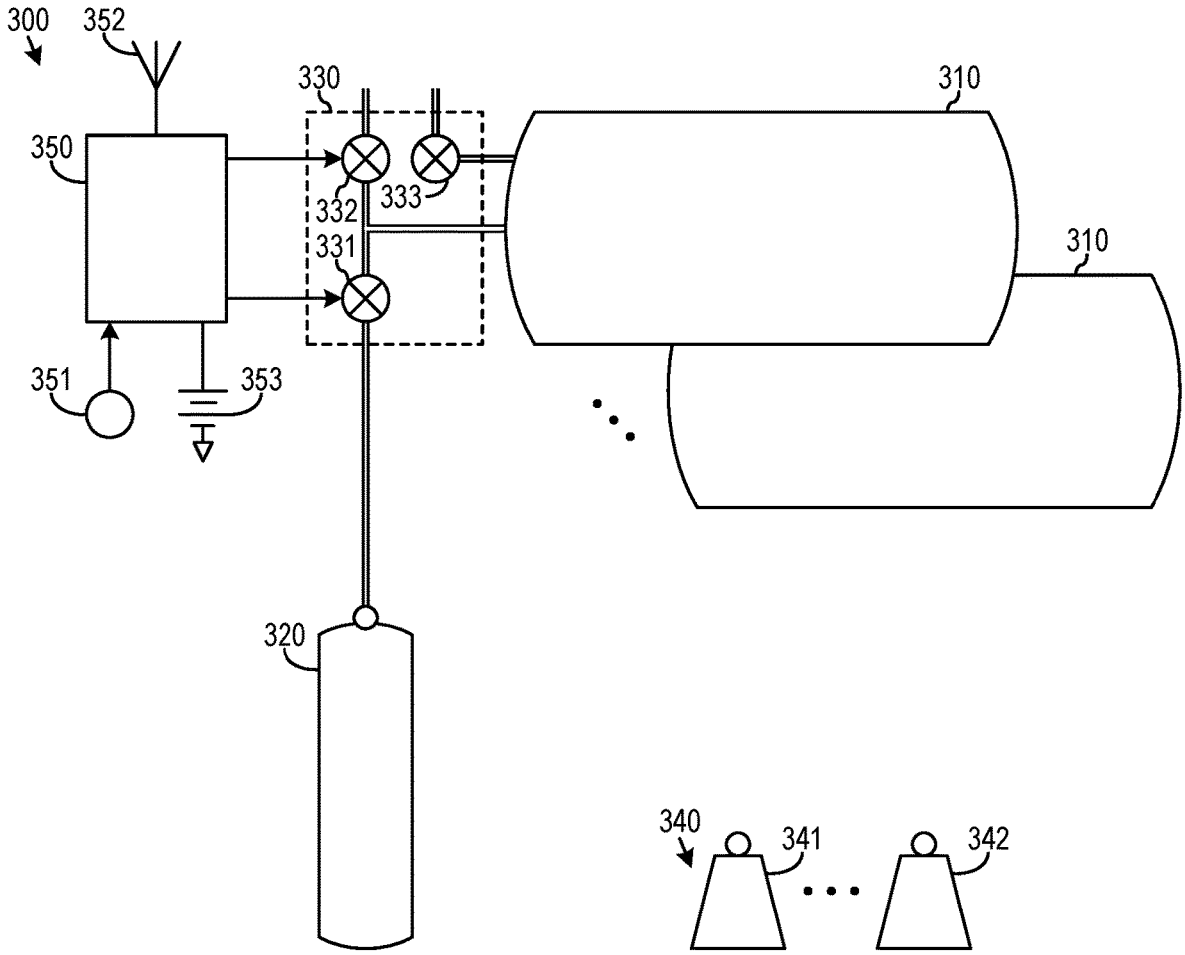
FIG. 3 is a block diagram of a retrofit kit for retrofitting a buoy to provide dynamic control of a freeboard of the buoy in accordance with an embodiment of the invention.

FIG. 3 is a block diagram of a retrofit kit 300 for retrofitting a buoy to provide dynamic control of a freeboard of the buoy in accordance with an embodiment of the invention. The retrofit kit 300 includes buoyancy chambers 310, an air reservoir 320, and a valve arrangement 330.

During retrofitting, the buoyancy chambers 310 surround a vertical axis of the buoy with a center of mass of the buoy disposed on the vertical axis below the buoyancy chambers 310. The center of mass of the buoy is either a dry center of mass of the buoy removed from a body of water or a wet center of mass of the buoy as reduced from the body of water displaced by the buoy when the buoyancy chambers 310 provide the minimum buoyancy. The buoyancy chambers 310 provide a variable buoyancy ranging from a minimum buoyancy to a maximum buoyancy. The air reservoir 320 provides air for an inflation of the buoyancy chambers 310. The valve arrangement 330 dynamically sets the freeboard of the buoy upon the inflation and a deflation of the buoyancy chambers 310 for varying the variable buoyancy between the minimum buoyancy and the maximum buoyancy. In one embodiment, the buoyancy chambers 310 are lift bags and the air reservoir 320 is at least one self-contained underwater breathing apparatus (SCUBA) tank.

The valve arrangement 330 dynamically sets the freeboard of the buoy anywhere between a negative value and a positive value. The valve arrangement 330 sets the freeboard to the positive value upon the inflation of the buoyancy chambers 310 with the air from the air reservoir 320 to provide the maximum buoyancy, and sets the freeboard to the negative value upon the deflation of the buoyancy chambers 310 to provide the minimum buoyancy. In an embodiment, the valve arrangement 330 includes a pressure sensor for measuring a gauge pressure of the buoyancy chambers 310.

In one embodiment, the valve arrangement 330 includes an inflation valve 331, a release valve 332, and an over-pressure valve 333 or valves. The inflation valve 331 controls passage of air from the air reservoir 320 to the buoyancy chambers 310 for increasing the variable buoyancy until the gauge pressure reaches a predetermined pressure. The release valve 332 releases gas from the buoyancy chambers 310 for lowering the variable buoyancy until the gauge pressure reaches another predetermined pressure. For self-preservation of the buoyancy chambers 310, the over-pressure valve 333 or valves prevent damage to the buoyancy chambers 310 by releasing excess air from the buoyancy chambers 310 while the gauge pressure exceeds a safety limit for the buoyancy chambers 310.

The retrofit kit 300 further includes a ballast 340 for disposal along the vertical axis below the buoyancy chambers 310. Typically, the buoy has the freeboard with an initial positive value before the retrofitting with the buoyancy chambers 310, the air reservoir 320, the valve arrangement 330, and the ballast 340, but, after the retrofitting, the valve arrangement 330 sets the freeboard anywhere between a negative value, which is achieved when the buoyancy chambers 310 provide the minimum buoyancy, and another positive value, which is achieved when the buoyancy chambers 310 provide the maximum buoyancy.

In one embodiment, the ballast 340 includes weights 341 through 342 from which a subset is selected for addition to the buoy during the retrofitting to set the freeboard at the negative value when the buoyancy chambers 310 provide the minimum buoyancy, but the selected subset remains unchanged after the retrofitting while the valve arrangement 330 sets the freeboard of the buoy anywhere between the negative and positive values. Typically, the buoy already has some ballast, and the selected weights 341 through 342 increase the total ballast. Thus, frequently not all of the weights 341 through 342 of the ballast 340 of the retrofit kit 300 are installed on the buoy during the retrofitting of the buoy. The negative value of the freeboard includes complete submersion of the buoy after the retrofitting for the buoy designed before the retrofitting to never submerge because the buoy has the freeboard with the initial positive value before the retrofitting.

The retrofit kit 300 further includes a control circuitry 350. In response to a measure of a turbulence of a body of water surrounding the buoy, the control circuitry 350 automatically directs the valve arrangement 330 to set the freeboard to a positive value just sufficient to inhibit overtopping of the buoy by the turbulence of the body of water. In response to the measure of the turbulence indicating the turbulence is so high that overtopping of the buoy by the turbulence of the body of water cannot be inhibited even while the buoyancy chambers 310 provide the maximum buoyancy, the control circuitry 350 automatically directs the valve arrangement 330 to set the freeboard to the negative value for completely submerging the buoy within the body of water and protecting the buoy from the turbulence of the body of water.

In one embodiment, the control circuitry 350 of the retrofit kit 300 further includes a sensor 351 for measuring a height of waves of the turbulence of the body of water surrounding the buoy, a radio-frequency receiver 352 for receiving the measure of the turbulence of the body of water surrounding the buoy, and a battery 353 for powering the control circuitry 350 and electrically actuating the valves 331 and 332 of the valve arrangement 330.

In one embodiment, in response to a detected approach by sensor 351 of a vessel on a collision course with the buoy, the control circuitry 350 directs the valve arrangement 330 to set the freeboard to the negative value for completely submerging the buoy and protecting the buoy from the vessel. In response to a radio signal received at receiver 352 requesting a temporary submergence of the buoy, the control circuitry 350 temporarily directs the valve arrangement 330 to set the freeboard to the negative value for completely submerging and concealing the buoy.

It will be appreciated that the dynamic control of the buoy's freeboard extends to dependence upon many factors, including sea state, wave dynamics, atmospheric pressure, temperature, day/night operation, stealth, or periodic or intermittent communication.

The valve arrangement 330 can set the freeboard of the buoy to a negative value at a specified depth within a body of water. The buoyancy chambers 310, such as compressible lift bags, might be unstable to perturbations, with a perturbed increased depth decreasing buoyancy that further increases depth or with a perturbed decreased depth increasing buoyancy that further decreases depth. However, such perturbations are small when the specified depth is below the range of wave action of turbulence in the body of water, and the specified depth is nearly statically maintained because the control circuitry 350 needs to make infrequent adjustments to the variable buoyancy of the buoyancy chambers 310.

From the above description of Retrofitting a Buoy to Provide Dynamic Control of a Freeboard of the Buoy, it is manifest that various techniques may be used for implementing the concepts of method 100 and systems 200 and 300 without departing from the scope of the claims. The described embodiments are to be considered in all respects as illustrative and not restrictive. For example, a toroidal chamber similar to an inner tube of a tire is considered to be multiple buoyancy chambers when the toroidal chamber encircles the vertical axis of the buoy. The methods and systems disclosed herein may be practiced in the absence of any element that is not specifically claimed and/or disclosed herein. It should also be understood that each of the method 100 or systems 200 or 300 is not limited to the particular embodiments described herein, but is capable of many embodiments without departing from the scope of the claims.

We claim:

1. A retrofit kit for retrofitting a buoy to provide dynamic control of a freeboard of the buoy, the retrofit kit comprising:

a plurality of buoyancy chambers for surrounding a vertical axis of the buoy with a center of mass of the buoy disposed on the vertical axis below the buoyancy chambers, the buoyancy chambers for providing a variable buoyancy ranging from a minimum buoyancy to a maximum buoyancy;

an air reservoir for an inflation of the buoyancy chambers; and a valve arrangement for dynamically setting the freeboard of the buoy upon the inflation and a deflation of the buoyancy chambers for varying the variable buoyancy between the minimum buoyancy and the maximum buoyancy, wherein the buoyancy chambers are lift bags and the air reservoir is at least one self-contained underwater breathing apparatus (SCUBA) tank.

2. A retrofit kit for retrofitting a buoy to provide dynamic control of a freeboard of the buoy, the retrofit kit comprising:

a plurality of buoyancy chambers for surrounding a vertical axis of the buoy with a center of mass of the buoy disposed on the vertical axis below the buoyancy chambers, the buoyancy chambers for providing a variable buoyancy ranging from a minimum buoyancy to a maximum buoyancy;

an air reservoir for an inflation of the buoyancy chambers; and a valve arrangement for dynamically setting the freeboard of the buoy upon the inflation and a deflation of the buoyancy chambers for varying the variable buoyancy between the minimum buoyancy and the maximum buoyancy, wherein the valve arrangement is for dynamically setting the freeboard of the buoy anywhere between a negative value and a positive value.

3. The retrofit kit of claim 2, wherein:

the valve arrangement is for setting the freeboard to the positive value upon the inflation of the buoyancy chambers with air from the air reservoir to provide the maximum buoyancy; and the valve arrangement is for setting the freeboard to the negative value upon the deflation of the buoyancy chambers to provide the minimum buoyancy.

4. A retrofit kit for retrofitting a buoy to provide dynamic control of a freeboard of the buoy, the retrofit kit comprising:

a plurality of buoyancy chambers for surrounding a vertical axis of the buoy with a center of mass of the buoy disposed on the vertical axis below the buoyancy chambers, the buoyancy chambers for providing a variable buoyancy ranging from a minimum buoyancy to a maximum buoyancy;

an air reservoir for an inflation of the buoyancy chambers;

a valve arrangement for dynamically setting the freeboard of the buoy upon the inflation and a deflation of the buoyancy chambers for varying the variable buoyancy between the minimum buoyancy and the maximum buoyancy; and a ballast for disposal along the vertical axis below the buoyancy chambers, wherein the buoy has the freeboard with a first positive value before the retrofitting with the buoyancy chambers, the air reservoir, the valve arrangement, and the ballast, but, after the retrofitting, the valve arrangement sets the freeboard anywhere between a negative value, which is achieved when the buoyancy chambers provide the minimum buoyancy, and a second positive value, which is achieved when the buoyancy chambers provide the maximum buoyancy.

5. The retrofit kit of claim 4 for the retrofitting of the buoy, wherein the ballast includes a plurality of weights from which a subset is selected for addition to the buoy during the retrofitting to set the freeboard at the negative value when the buoyancy chambers provide the minimum buoyancy, but the subset remains unchanged after the retrofitting while the valve arrangement sets the freeboard of the buoy anywhere between the negative value and the second positive value.

6. The retrofit kit of claim 4 for the retrofitting of the buoy, wherein the negative value of the freeboard includes complete submersion of the buoy after the retrofitting for the buoy designed before the retrofitting to never submerge because the buoy has the freeboard with the first positive value before the retrofitting.

7. The retrofit kit of claim 6, further comprising a control circuitry configured to:

in response to a measure of a turbulence of a body of water surrounding the buoy, dynamically direct the valve arrangement to set the freeboard to a third positive value just sufficient to inhibit overtopping of the buoy by the turbulence of the body of water; and in response to the measure of the turbulence indicating the turbulence is so high that overtopping of the buoy by the turbulence of the body of water cannot be inhibited even when the freeboard is the second positive value while the buoyancy chambers provide the maximum buoyancy, direct the valve arrangement to set the freeboard to the negative value for completely submerging the buoy within the body of water and protecting the buoy from the turbulence of the body of water.

8. The retrofit kit of claim 7, further comprising at least one of:

a sensor for measuring the measure that is a height of waves of the turbulence of the body of water surrounding the buoy; or a radio-frequency receiver for receiving the measure of the turbulence of the body of water surrounding the buoy.

9. The retrofit kit of claim 6, further comprising:

a control circuitry configured to, in response to a detected approach of a vessel on a collision course with the buoy, direct the valve arrangement to set the freeboard to the negative value for completely submerging the buoy and protecting the buoy from the vessel.

10. The retrofit kit of claim 6, further comprising:

a control circuitry configured to, in response to a radio signal requesting a temporary submergence of the buoy, temporarily direct the valve arrangement to set the freeboard to the negative value for completely submerging and concealing the buoy; and a radio-frequency receiver for receiving the radio signal requesting the temporary submergence of the buoy.

* * * * *